United States Patent [19]

Fox et al.

[11] Patent Number: 4,802,997

[45] Date of Patent: Feb. 7, 1989

[54] METHOD FOR THE TREATMENT OF TEXTILE SURFACES AND COMPOSITIONS FOR USE THEREIN

[75] Inventors: Rodney T. Fox, Cottingham; Raymond A. Cowen, Woodfield Lane; Hazel Pool, Derby; Robert V. Cook, Aston on Trent, all of Great Britain

[73] Assignee: Reckitt & Colman Products Limited, London, United Kingdom

[21] Appl. No.: 87,784

[22] Filed: Aug. 21, 1987

[30] Foreign Application Priority Data

Aug. 28, 1986 [GB] United Kingdom ..... 8620845

[51] Int. Cl.[4] ..... D06M 13/40

[52] U.S. Cl. ..... 252/8.6; 252/173; 252/174.11; 252/162

[58] Field of Search ..... 252/8.6

[56] References Cited

U.S. PATENT DOCUMENTS

| | | | |
|---|---|---|---|
| 2,165,586 | 7/1939 | Studer et al. | 87/5 |
| 3,418,243 | 12/1968 | Hoxie | 252/154 |
| 3,813,221 | 5/1974 | Stubits | 8/142 |
| 4,013,594 | 3/1977 | Froehlich et al. | 252/544 |
| 4,107,121 | 8/1978 | Stoy | 260/29.6 AB |
| 4,264,484 | 4/1981 | Patel | 260/29.6 F |
| 4,537,914 | 8/1985 | Smith et al. | 521/111 |
| 4,548,954 | 10/1985 | Smith et al. | 521/52 |
| 4,563,483 | 1/1986 | Smith et al. | 521/111 |
| 4,565,644 | 1/1986 | Smith et al. | 252/92 |
| 4,566,980 | 1/1986 | Smith | 252/8.6 |

FOREIGN PATENT DOCUMENTS

| | | | |
|---|---|---|---|
| 0062536 | 10/1982 | European Pat. Off. . | |
| 0164311 | 12/1985 | European Pat. Off. . | |
| 0178566 | 4/1986 | European Pat. Off. . | |
| 1467574 | 1/1969 | Fed. Rep. of Germany . | |
| 3530302 | 3/1987 | Fed. Rep. of Germany | 252/8.8 |
| 956921 | 8/1949 | France | 16/5 |
| 1055349 | 10/1953 | France | 14/4 |
| 1064089 | 12/1953 | France | 14/4 |
| 1069219 | 2/1954 | France | 14/4 |
| 1174524 | 11/1958 | France | 14/4 |
| 2443501 | 7/1980 | France . | |
| 1066001 | 4/1967 | United Kingdom . | |
| 1114697 | 5/1968 | United Kingdom . | |
| 2037311 | 5/1983 | United Kingdom . | |

OTHER PUBLICATIONS

Australan Patent Abstract, "Textile Treatment Softeners", 8/22/86.

*Seife-Ole-Fette-Wachse* 109, 414 (1983): "Teppichtrockenreiniger"-with translation.

*Primary Examiner*—John F. Niebling

*Assistant Examiner*—Isabelle Rodriguez

*Attorney, Agent, or Firm*—Frederick H. Rabin

[57] ABSTRACT

A method for the treatment of textiles surfaces has the steps:

(i) a solids treatment material including a swollen hydrogel containing aqueous treatment fluid is applied to a surface, (ii) force is then applied to release the treatment fluids from the hydrogel, (iii) the textile is allowed to dry and (iv) visible residues are removed from the surface.

The hydrogel is a hydrophilic homopolymer or copolymer of acrylic or methacrylic acid or salt/ester thereof; a homopolymer or copolymer of acrylonitrile; a cellulose ether, carboxylated cellulose derivative polyalkylene oxide or polyurethane optionally cross-linked with polysaccharide.

The treatment fluid is for cleansing, insect-proofing, fragrancing or antibacterial/antifungal purposes.

27 Claims, No Drawings

METHOD FOR THE TREATMENT OF TEXTILE SURFACES AND COMPOSITIONS FOR USE THEREIN

BACKGROUND OF THE INVENTION

The present invention relates to a method for the treatment of textile surfaces and to compositions for use therein.

It is well known to treat textile surfaces such as carpets, mats, upholstery, fabrics and wall-coverings in various ways, for example to impart a fragrance thereto, to condition them such as by the use of antistatic agents or to cleanse them such as by the use of powders or liquids.

In particular several classes of product are now offered for sale, for example air freshener powders, particulate solids for carpet care and consisting essentially of sawdust and/or ground seed husk, powders with a solvent content that nonetheless flow and purport to cleanse and detergents for use in aqueous medium, whether supplied as liquids or powders, for cleansing carpets.

The methods for using these various treatment compositions are substantially the same, viz apply the composition to the textile surface, allow the textile surface to dry, if necessary, and remove any residues preferably with a vacuum cleaner. Differences in the use of these various treatment compositions stem from differences in the nature and efficacy of the particular composition. Thus, air freshener powders which do not contain a cleansing agent do not perceptibly cleanse, although any excessive grease or water spillage may be partly absorbed thereby as they may be by carpet care compositions which contain sawdust and/or ground seed husk. Powders containing an organic solvent may produce a little cleansing but they are little better than sawdust and/or ground seed husk and the like when dampened. Moreover, care must be exercised not to introduce any naturally coloured material, e.g. wood or husks into a wet composition since colour therefrom may be transferred to the textile surface. In addition, compositions relying upon natural products are very difficult to standardise.

Carpet care products which are applied as a dilute solution, e.g. shampoos require the application of sufficient liquid to wet the carpet and its backing and this sometimes causes distortion and/or leaching of colourants from the carpet-backingmaterial. Furthermore, carpets treated in this way always take a relatively long time to dry.

The compositions which consist of a mixture of powders and liquids may exhibit phase separation on storage when adequate liquid for efficacious cleansing is incorporated therein. Frequently, it is difficult for a user by shaking the composition to disperse the solids material into the liquid phase ready for application. Reducing the liquid content so as to prevent phase separation can, however, limit the cleansing efficacy of the composition.

SUMMARY OF THE INVENTION

We have now developed a method for the treatment of textile surfaces involving the use of a wetting solids composition which acts as a carrier for the treatment materials in liquid form at high concentration and which does not separate on storage.

Accordingly, the present invention provides a method for the treatment of a textile surface which comprises the steps of (i) applying to the textile surface a solids treatment composition which includes therein a hydrogel swollen with a treatment fluid containing water;
(ii) allowing the composition to reabsorb fluid;
(iii) applying force to the composition thereby to release treatment fluid from the hydrogel;
(iv) allowing the textile surface to become substantially dry, and
(v) removing any visible residue of the solids treatment composition from the textile surface.

DETAILED DISCLOSURE

The term "solids treatment composition" as use herein means a deformable solid, a sprinkleable powder or a sprayable composition.

The treatment to which the textile surface is subjected may be at least one of the following:

cleansing the textile surface, in which case a suitable cleansing fluid is used; insect-proofing, in which case an insecticidal fluid is used; fragrancing, in which case a perfumed fluid is used; a biocidal or biostatic treatment in which case an antibiotic fluid is used; residual treatment, for example with an antistatic fluid or any of the foregoing fluids so as to achieve a residual or protracted effect.

In carrying out the method of the invention the force may be applied manually to the composition, for example by rubbing in the case of a deformable solid, or by brushing when a finely divided sprinkeable form is used, the composition being brushed so as to cause it to penetrate the pile on the textile surface thereby to contact more closely the textile material. Alternatively, when the composition is applied as a spray onto the textile surface the force is applied to the composition by the impact of the particles of the composition on the textile surface.

When force is applied to treatment compositions containing a hydrogel, treatment fluid exudes therefrom and it is believed that this is the mechanism whereby the treatment material is first distributed amongst the fibres of the textile material. When force ceases to be applied to the hydrogel containing treatment compositions the hydrogel reattracts the fluid and may reabsorb at least a part thereof. As a consequence, there is a reduced amount of free fluid in the textile material which can thus dry relatively rapidly.

Any visible residue, which is still damp, may be removed for example using a vacuum cleaner. This does a little work on the particles and as a consequence no static build-up is caused even on synthetic fibre textiles.

Adequate drying is effected in a far shorter time than when a textile surface is say cleaned with a traditional shampoo solution. Whilst adequate fluid to effect the required treatment is used in the present method, relatively less fluid is used than in say, a traditional wet shampooing method, and, accordingly, the drying time is shorter. Furthermore, since there is no protracted contact with the textile material as a consequence no loss of shape occurs through shrinkage etc.

The present invention also includes within its scope solids textile treatment compositions which comprise 0.3 to 70% by weight of a hydrogel, 5 to 99.5% by weight of water, optionally up to 40% by weight of an organic solvent, optionally up to 40% by weight of a flow aid and at least one ingredient selected from:

0.01 to 10% by weight of a perfume,
0.01 to 5% by weight of an insecticide,
0.01 to 5% by weight of an antistatic agent,
0.01 to 5% by weight of an antimicrobial agent, and
0.01 to 15% by weight of a surfactant.

The preferred compositions of the present invention contain from 10 to 25% by weight of a hydrogel and 35 to 90% by weight of water. For use as fragrancing compositions the preferred compositions contain from 0.5 to 2.0% by weight of a perfume; for use as insecticidal compositions the preferred compositions contain from 0.5 to 1.5% by weight of an insecticide; for use as antistatic treatment compositions the preferred compositions contain from 0.3 to 1.0% by weight of an antistatic agent; for use as antimicrobial compositions the preferred compositions contain from 0.3 to 1.0% by weight of an antimicrobial agent; whilst for use as cleansing compositions the compositions contain from 0.2 to 2.0% by weight of a surfactant.

By the term "hydrogel" is used herein is meant a natural or synthetic polymeric material which possesses the ability to swell in water but which does not dissolve in water. Generally, synthetic hydrogels are formed by polymerizing a hydrophilic monomer in an aqueous solution under conditions where the polymer becomes crosslinked so as to form a three dimensional polymer network.

Preferably, the hydrogel is a substantially water-insoluble, hydrophilic homopolymer or copolymer of acrylic or methacrylic acid, a salt or ester thereof; a homopolymer or copolymer of acrylamide or acrylonitrile, cellulose ether, carboxylated cellulose derivative, polyalkylene oxide or polyurethane. The polymer is cross-linked to a relatively low degree and but for the cross-linking would be essentially water-soluble.

The polymer may include in its structure a polysaccharide such as starch, for example in a graft copolymer.

Usually, the polymer has a number of free carboxylic acid groups neutralisable with, for example, an alkali metal ion.

Whilst there are preferred particle size distributions for particular purposes, all particles sizes can find application in the present invention.

The hydrogels for use in the compositions of the invention preferably, have particle size such that 2% are fines, i.e. below 10μ. More preferably, the particle size distribution is such that the majority of the particles have a longest dimension >250μ. There is no real upper limit to the particle size except in relation to sprinkleable and sprayable compositions where convention dictates the limits at e.g. 250–850μ.

Amongst the hydrogels that have been tested in connection with the present invention are those listed in Table 1 below.

TABLE 1

| | | |
|---|---|---|
| *ALCOSORB AB 3 | ex Allied Colloids | (cross-linked acrylamide copolymer) |
| *ALCOSORB AB 1 | ex Allied Colloids | (cross-linked acrylamide copolymer) |
| *PERMASORB 40 | ex National Adhesives & Resins Ltd | (cross-linked polyacrylamide) |
| *HIMOSAB 200 | ex Croxton & Garry | (cross-linked polyacrylamide) |
| *HIMOSAB 500 | ex Croxton & Garry | (cross-linked polyacrylamide) |
| *POLYMER DP6 3702 | ex Allied Colloids | modified cross-linked acrylamide copolymer |
| *POLYMER DP6 3703 | ex Allied Colloids | modified cross-linked acrylamide copolymer |
| *COURLOSE DP1006 | ex Courtaulds Chemicals & Plastics | (cross-linked carboxymethyl cellulose) |
| *COURLOSE DP1007 | ex Courtaulds Chemicals & Plastics | (cross-linked carboxymethyl cellulose) |
| *AQUASTORE | ex American Cyanamid | (cross-linked modified polyacrylamide) |
| *AQUASORB | ex Guardian Chemicals | (co-polymer of starch and acrylic acid with cellulose) |
| *AQUASORB (Micronised) | ex Guardian Chemicals | (co-polymer of starch and acrylic acid with cellulose) |
| *HYGRAMER | ex Polysystems Ltd | (cross-linked polyethylene oxide) |
| *LUQUASORB HC9780 | ex BASF | (cross-linked partially neutralized poly (acrylic acid) in the form of sodium salt) |
| *BROADLEAF P4 | ex Agricultural Polymers Ltd | (polyacrylamide copolymer) |

*Signifies a Trade Mark.

These materials are all supplied with principal particles sizes of from below 250μ to greater than 850μ.

Quick and simple methods have been devised for the testing of hydrogels for use in the present invention:

1. the so-called "Filter Paper Test" to gauge the extent to which the material under test releases fluids; and
2. the so-called "Centrifuge Test" to gauge the swelling capacity of the material under test.

In outline these tests are conducted as follows:

1. "Filter Paper Test" Weigh a filter paper (A grams) cut to the size of a Petri dish and place it in the lid of the Petri dish. Weigh the Petri dish (B grams) and add approximately 3 grams of the test product to the Petri dish. Then weigh accurately to determine the weight of the product added (C grams). Place the Petri dish lid containing the filter paper onto the Petri dish, invert and start a stop-clock. Tap the dish to loosen the product then remove the dish, leaving the product in the lid of the Petri dish on the filter paper. Re-weigh the dish accurately to determine the quantity of product remaining on the dish (D grams).

The test product is left on the filter paper for 60 seconds in total but the lid is shaken gently after 30 seconds and 45 seconds to ensure even distribution of the test product. After 60 seconds the filter paper is removed with forceps and the test material shaken off the paper and any adhering particles gently brushed off. The filter paper is immediately weighed (E grams).

The percentage liquid released $$\text{The percentage liquid released} = \frac{(E - A)}{[(B + C) - D]} \times 100$$

The test was conducted in quintuplicate at room temperature.

A typical textile treatment composition of the present invention which is in sprinkleable form will preferably show a liquid release of greater than 3.5%, preferably show 3.5 to 15%, in the above-mentioned Filter Paper Test.

2. "Centrifuge Test" 0.2 g aliquots of material under test are distributed uniformly in 100 g aliquots of tap water during 15 second stirring at 600 r.p.m. at room temperature. After standing for 2 hours the whole is homogenised to the eye by stirring with a broad blade and centrifuged at 4000 r.p.m. for 20 minutes. The centrifugate in two layers, the lower gelled layer and the supernatant more fluid layer, is measured and the size of the gelled layer is expressed as a percentage of the combined layers to give the swelling capacity as a percentage figure. This percentage figure is referred to herein as the gel value. The test is conducted in duplicate at room temperature.

The preferred hydrogels for use in the present invention preferably have a gel value in the range of from 35 to 70% in the above-mention Centrifuge Test. However, gel values above and below these limits may also be acceptable, depending upon the chemical nature and structure of the hydrogel and the intended use of the composition.

In preferred treatment compositions for use in the method of the present invention the hydrogel is admixed with an inert material that is substantially unaffected by water which is preferably hydrophilic, but is preferably not hygroscopic. Such materials, which we call flow aids, have been proposed for use in or as carpet care products heretofore. A flow aid is preferably included in the compositions of the invention in an amount of from 10 to 40% by weight. Suitable flow aids for use in the invention are chalk, kaolin, Fuller's earth, talc, bentonite, aluminosilicates, diatomaceous earth and cellulose materials.

Preferably, the ratio of the hydrogel to the flow aid is carefully controlled depending upon the end use of the composition. The choice of hydrogel is also more influenced by the end-use of the product than by this ratio.

Guidance as to compositional data for some formulations may be obtained from the data gained by applying the above tests. This coupled with particle size distribution data and the general chracter of the hydrogel in the particular use to which the composition is to be put enables a formulater to produce compositions suitable for the treatement of all textile surfaces ranging from upholstery grade fabrics and curtaining to carpets, for spot removal, cleansing, antistatic, antibacterial or insecticidal treatment and/or fragrancing. Clearly, the finer the textile surface and the shorter the "pile" the more finely divided the materials which are useable as a sprinkable compositions.

Such a composition can be formulated conveniently as a flowable composition that can be sprinkled from a suitable sprinkler container. The powder thus sprinkled at a dose rate of 75–150 g/m$^2$, preferably 100 g/m$^2$ may be worked into the pile of the carpet which becomes damp to the touch as a consequence. The whiteness of the originally applied composition rapidly deteriorates to a dirty grey, indicating up-take of soil from the carpet. When left for a period of up to an hour, the dampness of the carpet is found to have more or less disappeared and the residue of the treatment composition can easily be removed with a vacuum cleaner. The residue is found to be still damp. Relative cleanliness of the substrate carpet is immediately clear to the eye.

A perfume may be added to the composition to enhance the ambient aroma or to mask a bad odour. Furthermore, during removal of the residue the air emitted from the vacuum cleaner will be fragrant, as with previously known air freshener powders applied to carpets. Some fragrance may also be residual.

It has been found that a vacuum cleaner does not adequately remove particles below an approximate particle size of about 10μ or less. Thus, by incorporating some particles below this size, for example of an insecticide or antistatic material into the treatment compositions a residual insecticidal or antistatic effect may be imparted to the carpet.

The fluids used in the method of the invention are to some extent determined by the treatment undertaken. Generally speaking the treatment fluid will be water optionally with an organic solvent such as an alcohol, hydrocarbon or halohydrocarbon; and a surfactant such as an anionic, cationic, nonionic and/or amphoteric surfactant. An organic solvent is preferably included in the compositions of the invention in an amount of from 5 to 15% by weight. The fluid may be in the form of single or multiphase liquid. For the former a co-solvent becomes necessary where the remaining components are immiscible. For the latter, the separate phases may be emulsified optionally with the aid of an emulsifying agent which may be the same as or different from any surfactant present for its detergent function.

The following Examples, in which all concentrations are by weight of the composition, further illustrate the present invention:

EXAMPLE 1

A sprinkable insecticidal composition was prepared in a Gardner mixer by mixing the following components in the order and relative amounts shown below:

| | % w/w |
|---|---|
| HIMOSAB 500 (Particle size range 425–600μ) | 20.0 |
| Water | 59.0 |
| Malathion | 1.0 |
| Industrial methylated spirits | 5.0 |
| Isoparaffinic hydrocarbon (ISOPAR H - Trade Mark of Esso) | 15.0 |

When the powder produced was applied to a carpet and brushed with a polyethylene moulded brush it tended to roll into little balls causing a dampness on the carpet.

After allowing 40 minutes for drying of the carpet, the residue was easily picked-up with a vacuum cleaner. There remained an odour of malathion on the carpet thereafter, which persisted at least through the next day.

EXAMPLE 2

A sprinkleable antibacterial composition was prepared in a Gardner mixer in the proportions shown below by dissolving the tetradecyl trimethyl ammonium bromide in the water prior to addition to the hydrogel.

| | % w/w |
|---|---|
| AQUASTORE (particle size 600–850μ) | 20.0 |
| Tetradecyl trimethyl ammonium bromide | 0.5 |
| Water | 79.5 |

When the powder produced was applied to a carpet and brushed with a polyethylene moulded brush, it rolled together leaving a noticeable film on the carpet. The carpet was not wetted as much as with the cleansing compositions of Examples 5 to 8.

The residue was picked up with a vacuum cleaner after remaining on the carpet for 10 minutes. Fine powder particles remained in the pile.

EXAMPLE 3

A sprinkleable cleansing composition was prepared in a Gardner mixer by mixing the following components in the order and relative amounts shown below:

| | % w/w |
|---|---|
| ALCOSORB AB3 (particle size 250–335μ) | 10.0 |
| ALCOSORB AB1 (particle size 250μ) | 10.0 |
| Water | 59.5 |
| Sodium lauryl sulphate (89%) | 0.5 |
| Industrial methylated spirit | 5.0 |
| ISOPAR H. | 15.0 |

The product was a slightly lumpy powder but could be brushed into the carpet pile quite easily with a polyethylene moulded brush. A good soil uptake was observed. The visible residue was removed with a vacuum cleaner.

EXAMPLE 4

An air freshener composition was prepared by the methods used in the foregoing Examples. The components were used in the following amounts:

| | % w/w |
|---|---|
| Water | 74.0 |
| Industrial methylated spirits | 5.0 |
| Lavender perfume (4824) | 1.0 |
| LUQUASORB HC9780 (particle size range 250–350μ) | 20.0 |

The product was a lumpy mixture which could be sprinkled onto a carpet. Brushing the lumps with a polyethylene moulded brush broke up the lumps and caused penetration of the disintegrate into the carpet pile. No particular wetting of the carpet was noticed, but there was a strong odour of lavender on the carpet. This persisted after picking up the visible residue with a vacuum cleaner.

EXAMPLE 5

A sprinkleable cleansing composition was prepared as in the above Examples using the following components in the amounts given below:

| | % w/w |
|---|---|
| Water | 67.0 |
| Iso-propyl alcohol | 10.0 |
| COURLOSE - DP1006 (particle size range 425–600μ) | 20.0 |
| AMPHOLAK XC030 (cocoamphocarboxyglycinate 30% Active Ingredient) | 3.0 |

The fine powder that resulted was sprinkled over a carpet and was easily brushed in using a polyethylene moulded brush, resulting in a slightly damp carpet.

After allowing the carpet to dry, the bulk residue was removed with a vacuum cleaner.

EXAMPLE 6

A sprinkleable carpet cleanser was prepared using the undermentioned components by adding the liquids to the solids in a Gardner mixer:

| | % w/w |
|---|---|
| Water | 59.5 |
| Sodium lauryl sulphate (89%) | 0.5 |
| Isoparaffinic hydrocarbon (ISOPAR H ex Esso) | 20.0 |
| HYGRAMER (particle size range 250–420μ) | 20.0 |

The sprinkleable product was evaluated on a soiled nylon carpet. The product was easy to apply being flowable and easy to spread and was brushed into the carpet pile using a moulded polypropylene brush. Soil uptake by the product was noticeable. After allowing nearly one hour to dry, the residue was removed by a vacuum cleaner. The carpet was obviously cleaner afterwards than prior to treatment.

EXAMPLE 7

A sprinkleable cleansing composition was prepared in accordance with the method of Example 6, but with a lower water content, from the following components:

| | % w/w |
|---|---|
| Water | 34.5 |
| Sodium lauryl sulphate (89%) | 0.5 |
| Isoparaffinic hydrocarbon (SHELLSOL T ex Shell) | 15.0 |
| Calcium carbonate (FORDACAL MOS40) | 35.0 |
| Calcium carbonate (STURCAL H) | 5.0 |
| ALCOSORB AB3 (particle sizes range 250–420μ) | 10.0 |

The product was sprinkled onto a soiled, cut pile 100% polypropylene carpet.

It brushed in easily using a moulded polyethylene brush and there was a noticeable soil uptake by the powder. After one hour the residue was removed by a vacuum cleaner and the carpet was easily cleaner afterwards than prior to treatment.

EXAMPLE 8

A sprinkleable cleansing composition was prepared adding liquids to the solids (hydrogel plus cellulose) in a Gardner mixer:

| | % w/w |
|---|---|
| Water | 44.5 |
| Sodium lauryl sulphate (89%) | 0.5 |
| Isoparaffinic hydrocarbon (ISOPAR H ex Esso) | 15.0 |
| Industrial methylated spirits | 5.0 |
| Wood Cellulose (ARBOCEL BE600/30) | 10.0 |
| Polymer DP6 3703 (particle size range 250–355μ) | 25.0 |

This was easily brushed in and showed good soil uptake. There was no problem in picking up the visible residue with a vacuum cleaner.

EXAMPLE 9

The following composition was prepared by dispersing the hydrogel in the water and then adding the perfume.

| | % w/w |
|---|---|
| COURLOSE | 3.00 |
| Water | 96.75 |
| Perfume floral 17763 | 0.25 |

Using an *AFA 7510 trigger pump the product was sprayed onto a 100% nylon carpet and left a pleasant odour which was still present after 24 hours, following removal of visible residues with a vacuum cleaner.

*Trade Mark

EXAMPLE 10

A deformable solid textile surface cleaner was prepared using the undermentioned components:

| | % w/w |
|---|---|
| ALCOSORB AB1 <250μ | 5.0 |
| Water | 59.5 |
| Sodium Lauryl Sulphate (89%) | 0.5 |
| ISOPAR H | 15.0 |
| Industrial Methylated Spirits | 5.0 |
| Guar Hydroxypropyltrimonium Chloride | 10.0 |
| ARBOCEL BE 600/30 | 5.0 |

The water was added to the guar hydroxypropyltrimonium chloride followed by the sodium lauryl sulphate, the ISOPAR H and methylated spirits in a Gardner mixer. The ALCOSORB ABl and ARBOCEL were then added and the whole mixed to produce a deformable, solid ball which released liquid when pressure was applied thereto.

When the ball was pressed over an oil stain on a piece of carpet, the oil was taken up by the product. Continued rubbing caused particles of the ball to be rubbed off, after the style of a pencil mark eraser in use. As a consequence a clean surface was exposed to the stain. The soiled fragments were picked by a vacuum cleaner after all the stain had been removed.

The compositions of Examples 5, 6, 7 and 8 gave the results which are detailed in Table 2 below in the Filter Paper Test which is described hereinabove.

TABLE 2

| | Range | Mean | Variance |
|---|---|---|---|
| Example 5 | 0.67–1.00% | 0.74% | 0.02 |
| Example 6 | 0.65–0.77% | 0.73% | 0.01 |
| Example 7 | 5.70–6.35% | 6.04% | 0.08 |
| Example 8 | 3.68–4.04% | 3.89% | 0.02 |

The hydrogels used in the Examples were tested in the Centrifuge Test which is described hereinabove. The results are detailed in Table 3 below.

TABLE 3

| Hydrogel | Particle size in Microns | Centrifuge Test |
|---|---|---|
| HIMOSAB 500 | 425–600 | 68% |
| AQUASTORE | 600–850 | 48% |
| ALCOSORB AB3 | 250–355 | 47% |
| ALCOSORB AB3 | 250–420 | 45% |
| ALCOSORB AB1 | <250 | 9% |
| LUQUASORB HC9780 | 250–355 | 38% |

TABLE 3-continued

| Hydrogel | Particle size in Microns | Centrifuge Test |
|---|---|---|
| COURLOSE DP1006 | 425–600 | 14% |
| POLYMER DP6 3703 | 250–355 | 58% |

Certain hydrogels which are suitable for use in the present invention were tested in the Centrifuge Test which is described hereinabove prior to sieveing into fractions according to particle size. The results are detailed in Table 4 below.

TABLE 4

| Material | Centrifuge Test |
|---|---|
| ALCOSORB AB1 | 10% |
| ALCOSORB AB3 | 22% |
| POLYMER DP6 3702 | 43% |
| POLYMER DP6 3703 | 58% |
| PERMASORB 40 | 44% |
| HIMOSAB 200 | 67% |
| HIMOSAB 1500 | 52% |
| LUQUASORB HC9780 | 34% |
| AQUASORB | 85% |
| AQUASORB micronised | 38% |
| COURLOSE DP1006 | 15% |
| COURLOSE DP1007 | 10% |
| BROADLEAF P4 | 30% |
| AQUASTORE | 36% |

What is claimed is:

1. A method for the treatment of a textile surface which comprises the steps of:

applying to the textile surface a solids treatment composition, which comprises from 0.3 to 70% of a hydrogel swollen with a treatment fluid containing from 5 to 99.5% water, and an effective amount of treatment agent to release fluid from the hydrogel to effect treatment of the surface;

allowing the composition to reabsorb fluid;

allowing the textile surface to become substantially dry; and removing any visible residue of the treatment composition from the textile surface.

2. A method for the treatment of a textile surface as claimed in claim 1 in which work is done on the composition in applying it to the textile surface to release fluid from the hydrogel.

3. A method for the treatment of a textile surface as claimed in claim 2 in which the treatment is cleansing with a cleansing fluid, insect-proofing with an insecticidal fluid, fragrancing with a perfumed fluid, rendering biocidal or biostatic with an antibiotic fluid, or residual treatment with an antistatic fluid alone or in combination with any of the foregoing fluids.

4. A method as claimed in claim 3 in which the treatment composition is applied as a sprinkleable solid and work is done on the composition by brushing said solid on the textile surface.

5. A method as claimed in claim 3 in which the composition is applied as a spray and the work is done on the composition by the impact of the sprayed composition on the textile surface.

6. A method as claimed in claim 5 in which the solids treatment composition is applied from a suspension thereof in an aqueous medium.

7. A method as claimed in claim 3 in which the composition is applied as a deformable solid and the work is done on the composition by rubbing said solid on the textile surface.

8. A solids textile surface treatment composition which comprises about 0.3 to 70% by weight of a hydrogel-forming polymer, about 5 to 99.5% by weight of water, from 0 to about 40% by weight of a flow aid and at least one ingredient selected from:

about 0.01 to 10% by weight of a perfume,
about 0.01 to 5% by weight of an insecticide,
about 0.01 to 5% by weight of an antistatic agent,
about 0.01 to 5% by weight of an antimicrobial agent, and
about 0.01 to 15% by weight of a surfactant.

9. A textile surface treatment composition according to claim 8 which comprises 10 to 25% by weight of a hydrogel-forming polymer, 35 to 90% by weight of water, and at least one ingredient selected from:

0.5 to 2.0% by weight of a perfume,
0.5 to 1.5% by weight of an insecticide,
0.3 to 1.0% by weight of an antistatic agent,
0.3 to 1.0% by weight of an antimicrobial agent, and
0.2 to 2.0% by weight of a surfacant.

10. A composition according to claim 8 for textile surface fragrancing which comprises 10 to 25% by weight of a hydrogel-forming polymer, 35 to 90% by weight of water, from 0 to 40% by weight of a flow aid and 0.5 to 2.0% by weight of a perfume.

11. A composition according to claim 8 for textile surface insectidal treatment which comprises 10 to 25% by weight of a hydrogel-forming polymer, 35 to 90% by weight of water, from 0 to 40% by weight of an organic solvent, from 0 up to 40% by weight of a flow aid and 0.5 to 1.5% by weight of an insecticide.

12. A composition according to claim 8 for textile surface antistatic treatment which comprises 10 to 25% by weight of a hydrogel-forming polymer, 35 to 90% by weight of water, up from 0 to 40% by weight of an organic solvent, from 0 to 40% by weight of a flow aid and 0.3 to 1.0% by weight of an antistatic agent.

13. A composition according to claim 8 for textile surface antimicrobial treatment which comprises 10 to 25% by weight of a hydrogel-forming polymer, 35 to 90% by weight of water, from 0 to 40% by weight of an organic solvent, from 0 to 40% by weight of a flow aid and 0.3 to 1.0% by weight of an antimicrobial agent.

14. A composition according to claim 8 for textile surface cleansing which comprises 10 to 25% by weight of a hydrogel-forming polymer, 35 to 90% by weight of water, from 0 to 40% by weight of an organic solvent, from up to 40% by weight of a flow aid and from 0.3 to 2.0% by weight of a surfactant.

15. A composition according to claim 9 which includes from 5 to 15% by weight of an organic solvent.

16. A composition according to claim 9 which includes from 10 to 40% by weight of a flow aid.

17. A composition according to any of claims 10, 11, 13 or 14 which additionally contains about 0.3 to 1.0% by weight of an antistatic agent having a particle size of about 10 microns or less.

18. A composition according to claim 8 in which the hydrogel-forming polymer is a substantially water-insoluble, hydrophilic homopolymer or copolymer of acrylic or methacrylic acid, or a salt or ester thereof; a homopolymer or copolymer of acrylamide or acrylonitrile; a derivative of cellulose ethers; a carboxylated cellulose derivative, a derivative of polyalkylene oxide, a polyurethane or a mixture thereof.

19. A composition according to claim 18 in which the copolymer includes a polysaccharide in its structure.

20. A composition according to claim 18 in which the homopolymer or copolymer has free acid groups neutralisable with an alkali metal ion.

21. A composition according to claim 18 in which the hydrogel-forming polymer has a gel value in the range of from 35 to 70%.

22. A composition according to claim 18 in which the hydrogel-forming polymer has a particle size distribution such that the majority of the particles are greater than 250 microns in their longest dimension.

23. A composition according to claim 16 which includes a flow aid selected from the group consisting of chalk, kaolin, Fuller's earth, talc, bentonite, diatomaceous earth, an aluminosilicate and a cellulose material.

24. A composition according to claim 18 which shows a liquid release in the range of from 3.5 to 15% in the Filter-Paper Test.

25. A composition according to claim 8 which is in the form of a deformable solid.

26. A composition according to claim 8 which is in the form of a sprinkleable solid.

27. A composition according to claim 8 which is in the form of a sprayable composition.

* * * * *

UNITED STATES PATENT AND TRADEMARK OFFICE

CERTIFICATE OF CORRECTION

PATENT NO. : 4,802,997

DATED : February 7, 1989

INVENTOR(S) : Rodney T. Fox et al.

It is certified that error appears in the above-identified patent and that said Letters Patent is hereby corrected as shown below:

Column 5, line 39: change "chracter" to -- character --.

Column 12, line 3: change "up" to -- 0 --.

Signed and Sealed this

Twenty-fourth Day of April, 1990

*Attest:*

HARRY F. MANBECK, JR.

*Attesting Officer*

*Commissioner of Patents and Trademarks*